US005235920A

United States Patent [19]

Hector

[11] Patent Number: 5,235,920

[45] Date of Patent: Aug. 17, 1993

[54] SECURITY LOCK BOX

[75] Inventor: Larry F. Hector, Hinsdale, Ill.

[73] Assignee: LFH Corporation, Clarendon Hills, Ill.

[21] Appl. No.: 773,701

[22] Filed: Oct. 9, 1991

[51] Int. Cl.[5] ..... E05G 1/04

[52] U.S. Cl. ..... 109/51; 70/63; 70/168

[58] Field of Search ..... 109/45, 50–52, 109/59 R, 72; 70/58, 63, 170–173, 166–169

[56] References Cited

U.S. PATENT DOCUMENTS

| | | | |
|---|---|---|---|
| 1,261,046 | 4/1918 | McNamee | 109/51 X |
| 1,805,759 | 5/1931 | Chamberlain | 109/52 |
| 1,924,308 | 8/1933 | Cruze | 70/172 |
| 1,985,869 | 12/1934 | Millice | 70/170 X |
| 2,315,158 | 3/1943 | Markham | 70/63 X |
| 3,183,863 | 5/1965 | Jeffres | 70/173 X |
| 3,812,279 | 5/1974 | Voegeli | 70/63 X |
| 3,973,687 | 8/1976 | Glick | 70/169 X |
| 4,457,240 | 7/1984 | Hungerford | 70/63 X |
| 4,462,317 | 7/1984 | Franko et al. | 70/63 X |
| 4,474,116 | 10/1984 | Castenada et al. | 70/63 X |
| 4,628,827 | 12/1986 | Litter | 109/50 |
| 4,809,890 | 3/1989 | Tsigadas | 70/63 X |
| 4,977,764 | 12/1990 | Runnalls | 70/63 |

FOREIGN PATENT DOCUMENTS

| | | | |
|---|---|---|---|
| 4492 | 10/1931 | Australia | 70/173 |

*Primary Examiner*—Peter M. Cuomo
*Assistant Examiner*—Suzanne L. Dino
*Attorney, Agent, or Firm*—Patula & Associates

[57] ABSTRACT

A security container, and a security cover that is locked via a locking mechanism onto the security container. The security cove is sized to fit snugly and substantially overlap the security container to prevent a prying instrument from being inserted between the security cover and the security container. Further, the long sidewalls create an overlap of the security cover and security container to hinder any attempt to insert a prying instrument between the container and the cover, further frustrating attempts to pry the cover off of the container.

8 Claims, 4 Drawing Sheets

SECURITY LOCK BOX

This invention teaches a novel lock box to securely store valuables.

BACKGROUND OF THE INVENTION

The safe storage of small valuables has always been of considerable concern. While there are many safes on the market, most are expensive and difficult to install and require considerable space. The present invention solves the problem of safe storage of valuables by providing an easy to install lock box. Moreover, the invention's design makes the lock box highly tamper-resistant. The invention's utility is augmented by its simple construction, which allows the device to be manufactured inexpensively, therefore putting it within the easy financial reach of the home owner, small businessperson, or anyone else who considers the safe storage of small valuables a priority.

Various other lock type boxes have been described in the prior art. For example, U.S. Pat. No. 1,985,869 to Millice describes a "temporary safe". However, its use is essentially for deployment in stores or theaters, where the services of the safe can be rented, and is not for personal use as in the present invention. As such, the device in Millice differs in structure from the present invention because it contains additional components and hardware that make Millice more expensive to manufacture and complicated to use.

U.S. Pat. No. 4,248,067 to Sears and U.S. Pat. No. 4,444,031 to Watson both disclose a manner for removably attaching and locking a box to a surface such as a wall or floor, but differs in structure and function from the present invention because the locking mechanisms in Sears and Watson secure the boxes to a wall, floor or other stationary surface, whereas the locking mechanism in the present invention locks the cover of the container to the base of the container which is immovable.

U.S. Pat. No. 4,457,240 to Hungerford discloses a portable lock box. However, Hungerford differs from the present invention in that it is intended to be a portable rather than stationary lock box. Furthermore, the cover is attached to the security container via radially projecting locking pins at the bottom of the sides of the cover which fit into slots in the side of the container, which the present invention renders unnecessary.

U.S. Pat. No. 4,462,317 to Franko, et al., also discloses a lock type box, but differs from the present invention in that it relies on a different manner of securing the top of the box to the bottom of the box, in particular, a cavity/groove mechanism that the present invention does not need to incorporate.

BRIEF SUMMARY OF THE INVENTION

The invention consists of a security container, and a security cover that is locked via a locking mechanism onto the security container. The security cover is sized to fit snugly and substantially overlap the security container to prevent a prying instrument from being inserted between the security cover and the security container. Further, the long sidewalls create an overlap of the security cover and security container to hinder any attempt to insert a prying instrument between the container and the cover, further frustrating attempts to pry the cover off of the container.

The open end of the security container has an inside surface lip that completely encompasses the circumference of the open end of the security container. Attached to the security cover is a locking mechanism, which in turn has connected to it a locking flange that is engaged or rotated when a key is inserted in the top portion.

When the cover is placed on the security container, and the key inserted into the locking mechanism and rotated, the locking flange is orientated so that the tip of the flange is positioned under and abuts the lip of the security container. The contact and abutment of the flange against the lip prevents the cover from being lifted off the security container thereby preventing access therewith.

To remove the cover, the key is inserted into the lock and rotated so that the locking flange is moved out from under and abutment of the lip, and the cover can then be easily lifted off the security container and the valuables contained therein accessed.

It is the principle object of the invention to provide a means for the safe storage of valuables.

It is a further object of the invention to provide an economical way to store valuables.

It is also an object of the invention to provide a container with a cover that is highly tamper-resistant.

It is an additional object of the invention to teach a simple and novel method of securing and locking a cover to a container.

It is another object of the invention to teach a novel structure of a container with a cover having long sides which frustrate attempts to pry the cover off of the container.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF DRAWINGS

A fuller understanding of the foregoing may be had by reference to the accompanying drawings, wherein.

DESCRIPTION OF THE PREFERRED EMBODIMENT OF THE INVENTION

Figure 1:
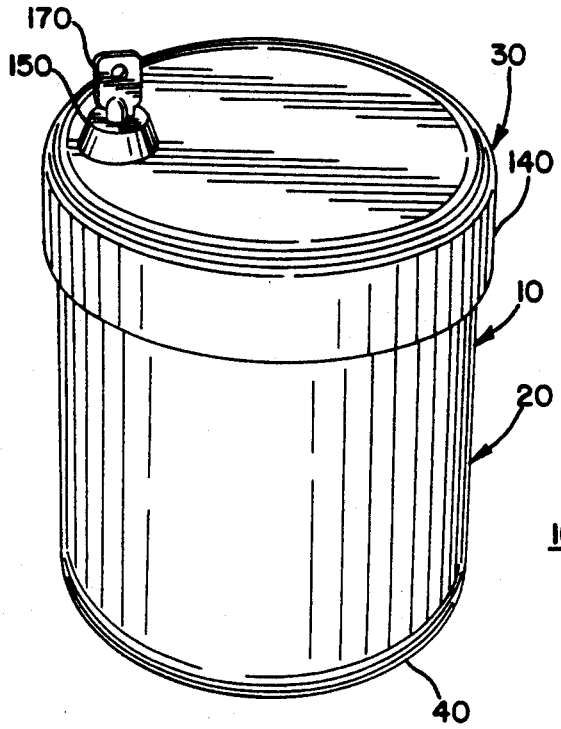
FIG. 1 is a perspective view of the preferred embodiment of the present invention.

While the invention is susceptible of embodiment in many different forms there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

Figure 2:
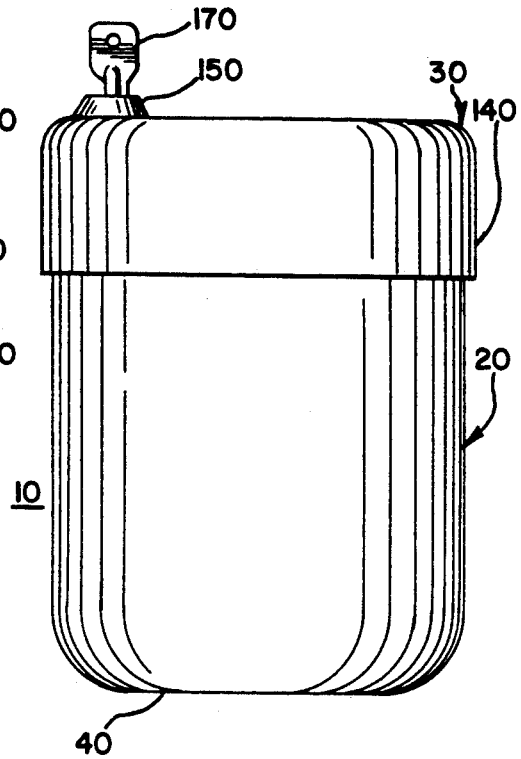
FIG. 2 is a side view of the invention of FIG. 1.
Figure 4:
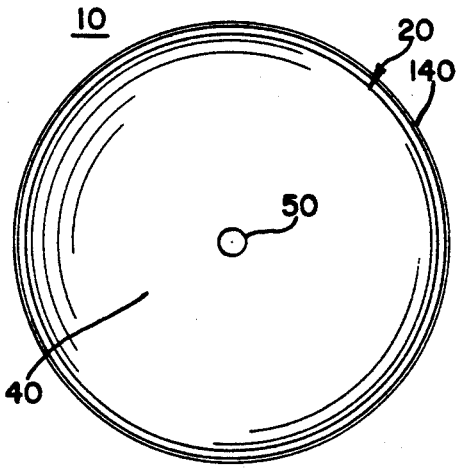
FIG. 4 is a bottom view of the invention of FIG. 1.

Referring now to the drawings, FIGS. 1 and 2 show the invention 10, consisting of a security container 20, and a security cover 30. The security container 20 and the security cover 30 are preferably constructed from a high strength metal or metal alloy, although other high strength, tamper resistant materials may be used. The security container 20 has a closed end or bottom 40, the bottom 40 having a retaining hole 50 as see in FIGS. 4 and 6. In the preferred embodiment, the closed bottom 40 forms one piece with the sides 140 of the security container 20.

Figure 8:
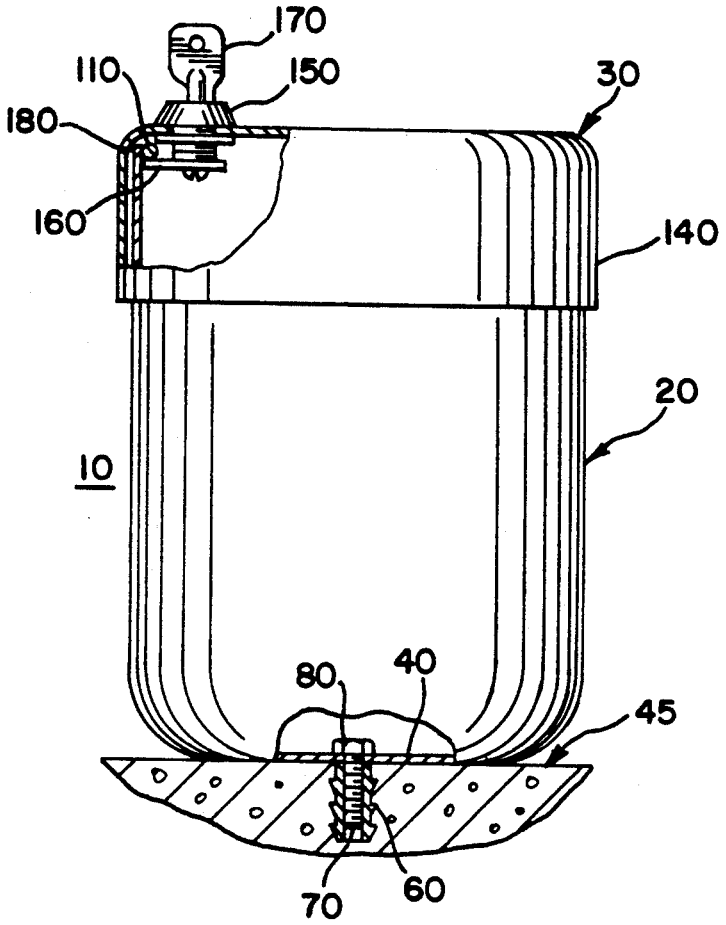
FIG. 8 is a side view of the invention of FIG. 1.

The security container 20 is securely and permanently attached to a hard superstructure surface 45 such as a wall, floor or ceiling, and is made of a material such as concrete, wood, brick, wallboard or plaster as shown in FIG. 8. In one embodiment, the anchor consists of a shield 60, driven into the concrete or wood surface 45, with the anchor bolt 70 inserted through the retaining hole 50 and into the shield 60. Because the diameter of the head 80 of the anchor bolt is larger than the diameter of the retaining hole 50, the security container 20 will remain securely fastened in one place. This configuration reduces the likelihood that a would be thief could detach the invention 10 from the superstructure 45. Because the retaining hole 50 is sized larger than shaft 75 of anchor bolt 70, the invention 10 rotates freely around anchor bolt 70, preventing the thief from rotating the anchor bolt 70 out of shield 60.

Figure 9:
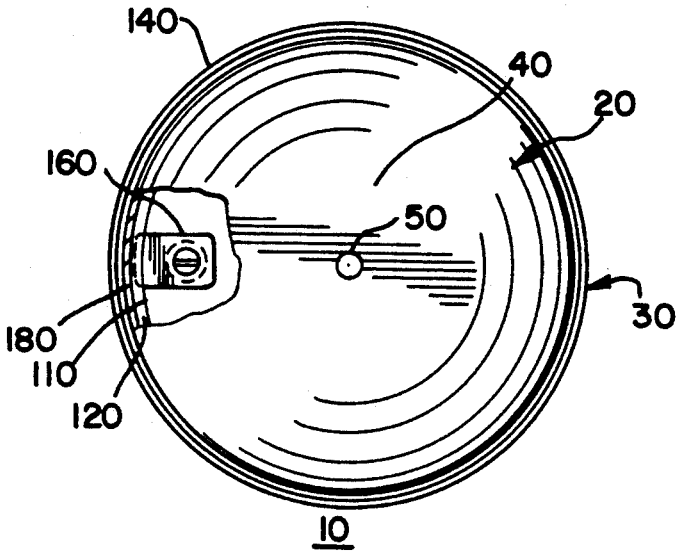
FIG. 9 is bottom view of the invention of FIG. 1.
Figure 11:
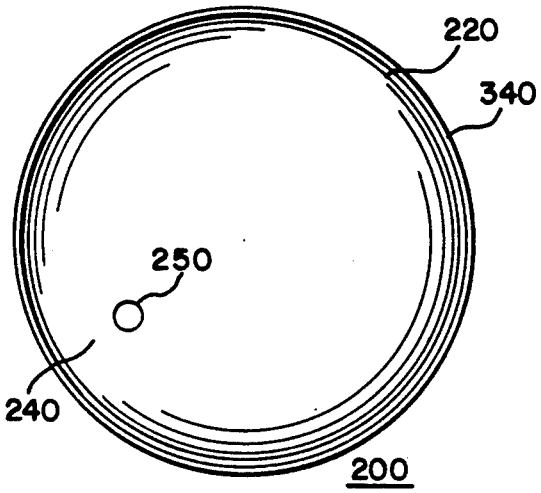
FIG. 11 is bottom view of an alternate embodiment of the invention of FIG. 1.
Figure 10:
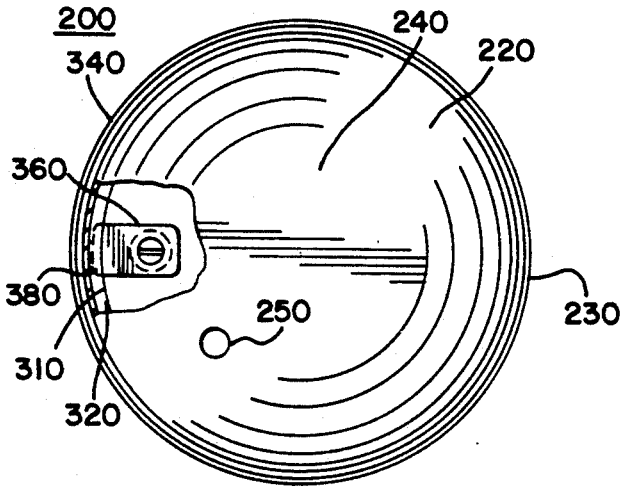
FIG. 10 is bottom cut-away view of an alternate embodiment of the secruity container with cover of the invention of FIG. 1.
Figure 12:
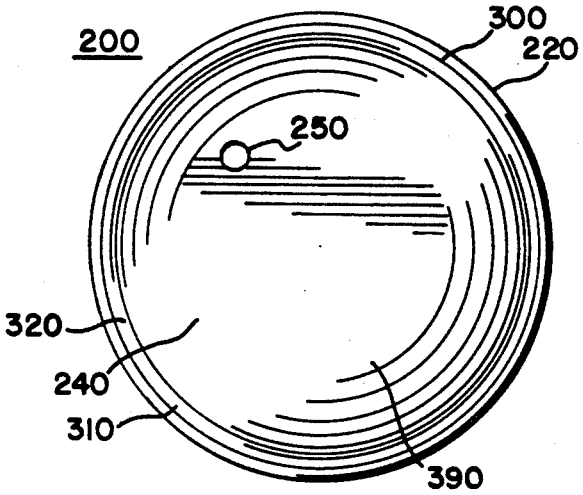
FIG. 12 is a top view an alternate embodiement of the security container of FIG. 1.

In the preferred embodiment shown in FIGS. 1 through 9, the retaining hole 50 is placed at the center of the bottom 40 of the security container 20. An alternate embodiment, shown in FIGS. 10 through 12, shows the retaining hole 250 placed off-center of the bottom 240 of the security container 220. Again, attempts by a would be thief to rotate the anchor bolt 70 out of the shield 60 thus detaching the invention 200 from the superstructure surface 45 would be frustrated, because the off-center retaining hole 250 makes the invention 200 cumbersome to rotate. This alternate embodiment is particularly effective if the invention is placed in proximity to another superstructure surface, such as a wall.

Figure 7:
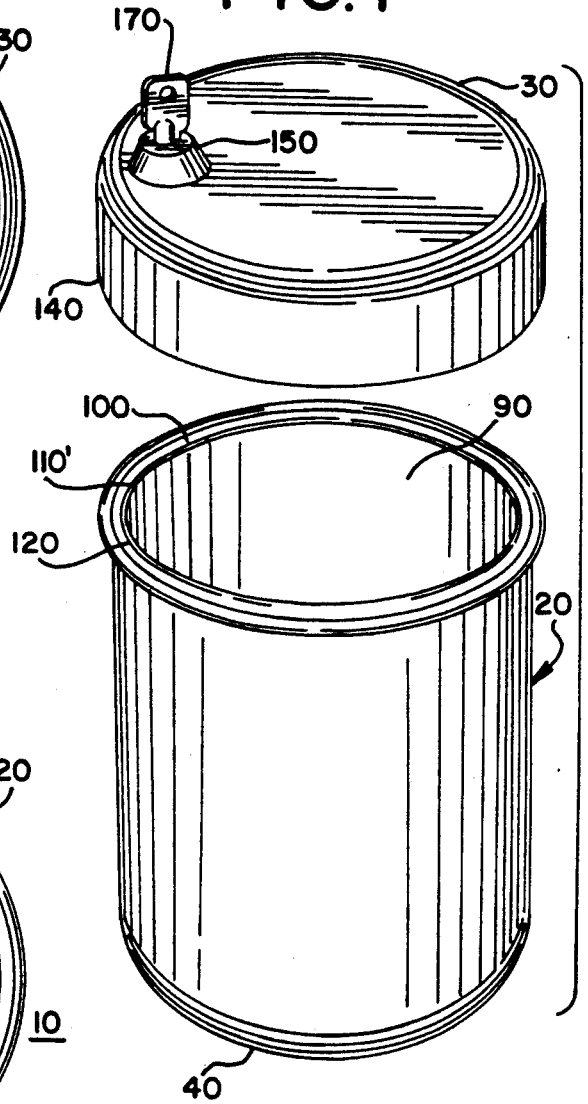
FIG. 7 is an exploded perspective view of the invention of FIG. 1.
Figure 6:
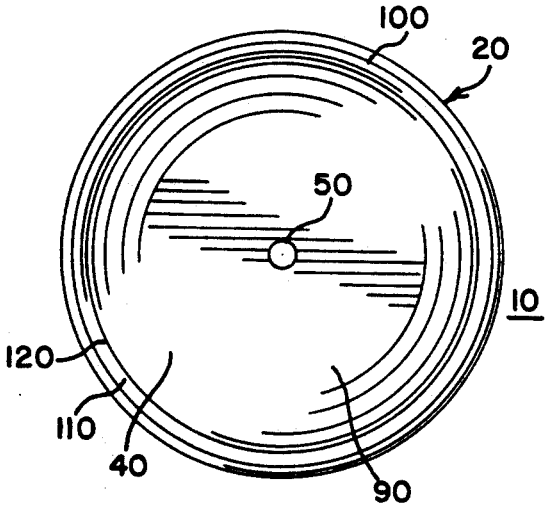
FIG. 6 is a top view of the security container of FIG. 1.

The security container 20 also has an open end, 90, opposite the closed bottom 40 as shown in FIGS. 6 and 7. Around the circumference of the open end 90 is an interior perimeter 100, and on the interior perimeter 100 an abutment 105. The abutment 105 could be a lip 110, of any size or configuration. In the preferred embodiment, the lip 110 is formed by attaching an independent formed ring 120 sized to encompass the entire interior perimeter 100 of the security container 20. In an alternative embodiment, the lip 110 may be formed from a top portion of the security container 20 bent perpendicularly to the sides 140 of the security container 20.

The security cover 30, has sides 140 precisely sized to fit snugly over the exterior of security container 20 as is shown in FIG. 2. The close fit between the sides 140 of the security container 20 and the sides 140 of the security cover 30 frustrate attempts by a thief to insert a prying instrument between them, preventing the security cover 30 from being pried off of the container 20. The sides 140 of the cover 30 are of a predetermined length, further preventing the cover 30, once locked onto the container 20, from being pried off of the container 20 with a crowbar or other instrument.

Figure 3:
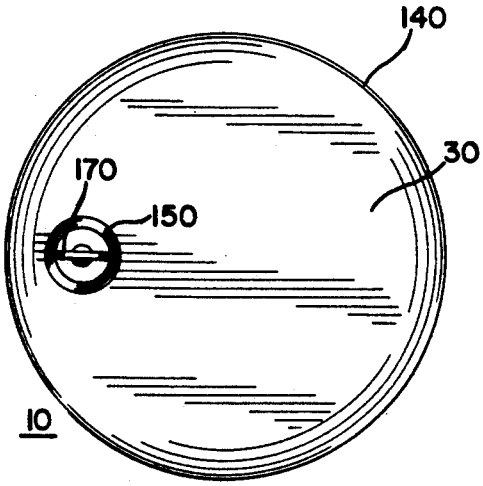
FIG. 3 is a top view of the invention of FIG. 1.
Figure 5:
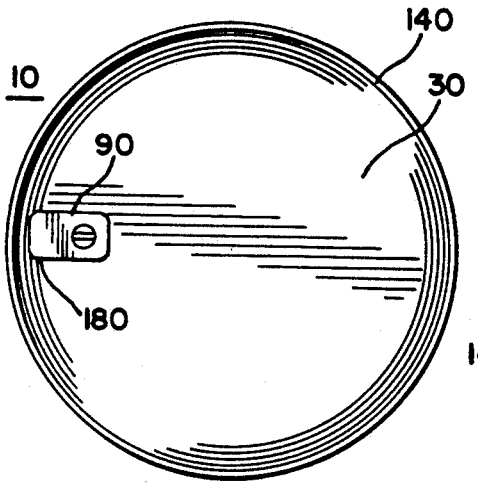
FIG. 5 is a bottom view of the cover of the invention of FIG. 1.

As illustrated in FIG. 3, the cover has disposed on it a cylindrical lock 150. It should be understood that many different types of locks would work equally as well. In FIGS. 5, 8 and 9 it can be seen that the lock 150 has an engaging assembly 155. In the preferred embodiment, the engaging device 155 is a locking flange 160, placed so that when the security cover 30 is positioned over the container 20 and a key 170 is inserted in the cylindrical lock 150 and turned, the tip 180 of the locking flange 160 is rotated under the lip 110, preventing the security cover 30 from being removed from being removed form security container 20, locking the cover 30 securely onto the container 20. Re-inserting the key 170, and rotating the key 170 and thus the locking flange 160 in the opposite direction re-orientates the tip 180 of the locking flange 160 so that it no longer abuts the lip 110, allowing the security cover 30 to be lifted off of the security container 20.

Alternative embodiments of the invention would include a square or rectangularly shaped security container and cover, the structure and operation of which would be as described above. Other alternative embodiments would include security containers having lips not completely encompassing the interior perimeter of the security container, or as already noted, a security container having a lip formed from the side of the container.

The foregoing specification describes only the preferred embodiment of the invention as shown. Other embodiments besides may be articulated as well. The terms and expressions therefore serve only to describe the invention by example only and not to limit the invention. It is expected that others will perceive differences which while differing from the foregoing, do not depart from the spirit and scope of the invention herein described and claimed.

I claim:

1. A security lock box, comprising:

means for containing having an outside surface, said containing means also having first and second ends, and on said first end a closed bottom and on said second end an open end, said second end also having an interior perimeter, and disposed on said interior perimeter, a means for abutting consisting of a radially inwardly extending lip disposed on a portion of the interior perimeter of the containing means;

means for covering said open end of said containing means, said covering means having sides adapted to overlap a portion of the outside surface of said containing means;

means for locking said covering means to said containing means, said locking means having a means for engaging said lip, said engaging means being a positionable flange adapted to engage said lip of said containing means when said covering means is fitted onto said containing means; and means for anchoring said containing means to the surface of a superstructure, said bottom of said containing means has a center and said anchoring means comprises a single retaining hole and anchor bolt disposed at a point off said center of said bottom of said containing means.

2. The invention of claim 1, wherein said radially inwardly extending lip encompasses the entire interior perimeter of said containing means.

3. The invention of claim 2, wherein said covering means has sides adapted to overlap a portion of the outside surface of said containing means.

4. The invention of claim 2, wherein said radially inwardly extending lip is a ring sized to fit said interior perimeter of said containing means.

5. The invention of claim 4, wherein said covering means has sides adapted to overlap a portion of the outside surface of said containing means.

6. A security lock box, comprising:

a means for containing having an outside surface, said containing means also having a first end and a second end, a closed bottom on said first end, and on said second end, an open end and an interior perimeter having a radially inwardly extending lip disposed on a portion of said interior perimeter of said containing means and encompassing the entire interior perimeter of said containing means;

a means for covering adapted to cover said open end of said containing means, said covering means also having sides adapted to overlap a portion of the outside surface of said containing means;

a means for locking said covering means to said containing means, said locking means having a positionable flange adapted to abut said radially inwardly extending lip of said containing means when said covering means is fitted onto said containing means; and a means for anchoring said containing means to a fixed superstructure, said bottom of said containing means has a center and said anchoring means comprises a single retaining hole and anchor bolt disposed at a point off said center of said bottom of said containing means.

7. The invention of claim 6, wherein said radially inwardly extending lip is a ring sized to encompass said interior perimeter of said containing means.

8. A security lock box, comprising:

means for containing having an outside surface, said containing means also having a first end and a second end, a closed bottom on said first end, and on said second end, an open end and an interior perimeter having a radially inwardly extending lip disposed on a portion of said interior perimeter of said containing means;

means for covering adapted to cover said open end of said containing means, said covering means also having sides adapted to overlap a portion of the outside surface of said containing means;

a means for locking said covering means to said containing means, said locking means having a positionable flange adapted to abut said radially inwardly extending lip of said containing means when said covering means is fitted onto said containing means; and a means for anchoring said containing means to a fixed superstructure, said bottom of said containing means has a center and said anchoring means comprises a single retaining hole and anchor bolt disposed at a point off said center of said bottom of said containing means.

* * * * *